US010001332B1

(12) United States Patent
Friend

(10) Patent No.: US 10,001,332 B1
(45) Date of Patent: Jun. 19, 2018

(54) RIFLE APPARATUS, SYSTEM, ASSEMBLY, AND METHOD

(71) Applicant: Michael Leon Friend, Wyandotte, OK (US)

(72) Inventor: Michael Leon Friend, Wyandotte, OK (US)

( * ) Notice: Subject to any disclaimer, the term of this patent is extended or adjusted under 35 U.S.C. 154(b) by 0 days. days.

(21) Appl. No.: 15/422,631

(22) Filed: Feb. 2, 2017

Related U.S. Application Data

(63) Continuation of application No. 14/986,426, filed on Dec. 31, 2015, now Pat. No. 9,638,484.

(60) Provisional application No. 62/101,055, filed on Jan. 8, 2015.

(51) Int. Cl.

| | |
|---|---|
| ***F41A 3/66*** | (2006.01) |
| ***F41A 11/02*** | (2006.01) |
| ***F41A 17/38*** | (2006.01) |
| ***F41A 35/06*** | (2006.01) |
| ***F41A 21/48*** | (2006.01) |

(52) U.S. Cl.
CPC ..... *F41A 11/02* (2013.01); *F41A 17/38* (2013.01); *F41A 21/482* (2013.01); *F41A 35/06* (2013.01)

(58) Field of Classification Search
CPC .... F41A 11/02; F41A 3/66; F41A 5/18; F41A 5/26
USPC ..... 42/75.01, 75.02, 14, 16; 89/128, 11, 89/191.01, 191.02, 149, 192, 1.4, 194
See application file for complete search history.

(56) References Cited

U.S. PATENT DOCUMENTS

| | | | | |
|---|---|---|---|---|
| 3,883,977 | A | 5/1975 | McClure | |
| 4,765,224 | A | 8/1988 | Morris | |
| 6,959,509 | B2 | 11/2005 | Vais | |
| 7,451,564 | B2 | 11/2008 | Wait | |
| 7,775,150 | B2 | 8/2010 | Hochstrate | |
| 7,900,546 | B2 | 3/2011 | Bordson | |
| 8,087,194 | B1 | 1/2012 | Vuksanovich | |
| 8,141,287 | B2 * | 3/2012 | Dubois | F41A 21/482 42/75.01 |
| 8,266,998 | B1 | 9/2012 | Davis | |
| 8,336,436 | B2 | 12/2012 | Kincel | |
| 8,561,517 | B2 | 10/2013 | Brown | |
| D705,384 | S | 5/2014 | Underwood | |
| 8,726,554 | B2 | 5/2014 | Klassen | |
| 8,739,449 | B2 | 6/2014 | Patel | |

(Continued)

OTHER PUBLICATIONS

Internet Printout; https://troyind.com/products/ambidextrous-charging-handle; 2016; US.

(Continued)

*Primary Examiner* — Reginald Tillman, Jr.
(74) *Attorney, Agent, or Firm* — Dennis D. Brown; Brown Patent Law, P.L.L.C.

(57) ABSTRACT

A rifle apparatus and method wherein the rifle includes a replaceable, threaded, adjustable barrel assembly which is configured for quickly changing the barrel length of the rifle, converting the rifle for using a different caliber of ammunition, and/or accurately determining and quickly setting the headspace in the firing chamber of the weapon for firing the new ammunition. Further, the rifle apparatus preferably also includes a replaceable lower receiver with a well opening and a corresponding magazine retention and release assembly for receiving a magazine clip for the caliber of ammunition fired by the replaceable barrel.

5 Claims, 19 Drawing Sheets

(56) References Cited

U.S. PATENT DOCUMENTS

| | | | | |
|---|---|---|---|---|
| 8,783,160 | B2 * | 7/2014 | Hochstrate | F41A 3/66 42/71.01 |
| 9,057,576 | B2 | 6/2015 | Barrett et al. | |
| 9,194,637 | B2 | 11/2015 | Mather | |
| 9,194,638 | B2 | 11/2015 | Larson, Jr. et al. | |
| 2012/0167433 | A1 | 7/2012 | Robbins et al. | |
| 2012/0216439 | A1 * | 8/2012 | Barrett | F41A 3/26 42/75.02 |
| 2012/0297656 | A1 | 11/2012 | Langevin et al. | |
| 2014/0230297 | A1 | 8/2014 | Larson, Jr. et al. | |
| 2014/0325886 | A1 | 11/2014 | Mather | |
| 2015/0007478 | A1 | 1/2015 | Barrett et al. | |
| 2016/0033218 | A1 * | 2/2016 | Folkestad, II | F41A 3/66 89/194 |
| 2017/0010064 | A1 * | 1/2017 | Karagias | F41C 23/04 |
| 2017/0122684 | A1 * | 5/2017 | Drake | F41A 11/02 |

OTHER PUBLICATIONS

Internet Printout; http://www.bravocompanyusa.com/BCMGUNFIGHTER-Charging-Handle-GFH-Mod-44-AMBI-p/bcm-gfh-mod-a44-556ambi.htm; US.

Internet Printout; http://www.gem-tech.com/store/pc/GSG-AK-47-Adapter-p54.htm; US.

* cited by examiner

RIFLE APPARATUS, SYSTEM, ASSEMBLY, AND METHOD

RELATED CASE

This application is a continuation application of co-pending U.S. patent application Ser. No. 14/986,426 filed Dec. 31, 2015, which claims the benefit of U.S. Provisional Patent Application No. 62/101,055 filed Jan. 8, 2015.

FIELD OF THE INVENTION

The present invention relates to rifle apparatuses, systems, assemblies, and methods such as those, by way of example, in the nature of an AK 47 or an AR 15.

BACKGROUND OF THE INVENTION

A need exists for an improved AK 47-type rifle apparatus, system, assembly, and method which will allow the user to more easily change the caliber and the barrel length of the weapon.

SUMMARY OF THE INVENTION

The present invention provides an inventive rifle apparatus, system, assembly, and method which satisfy the needs identified above. The inventive rifle (a) can be quickly changed and converted to different calibers and barrel lengths, (b) is modular and ergonomically designed, (c) is engineered for reliability, and (d) provides a much simpler system and method for accurately setting the headspace in the firing chamber when the rifle is converted for firing ammunition of a different caliber.

In one aspect, there is provided a rifle apparatus for firing a plurality of different calibers of ammunition. The rifle apparatus preferably comprises: (a) a receiver body having a barrel attachment nose projecting from a forward end of the receiver body, wherein the barrel attachment nose has exterior threads thereon; (b) a replaceable rifle barrel for firing at least a selected one of the plurality of different calibers of ammunition, the replaceable rifle barrel having a rearward end portion and a threaded portion forwardly of the rearward end portion, wherein the rearward end portion of the replaceable rifle barrel is receivable in the barrel attachment nose of the receiver body and the threaded portion of the replaceable barrel has exterior threads thereon; (c) a barrel attachment collar positioned around the replaceable rifle barrel, wherein the barrel attachment collar has a threaded portion with interior threads sized for threaded attachment to the exterior threads of the barrel attachment nose and the barrel attachment collar also has an inwardly extending retention shoulder positioned forwardly of the threaded portion of the barrel attachment collar; and (d) a barrel adjustment nut having interior threads and an outwardly extending retention shoulder, wherein the barrel adjustment nut is threadedly received on the threaded portion of the replaceable rifle barrel and the outwardly extending retention shoulder of the barrel adjustment nut is configured and is positioned within the barrel attachment collar for abutting a rearward surface of the inwardly extending retention shoulder of the barrel attachment collar.

In another aspect, there is provided a method using the rifle apparatus described above for installing the replaceable rifle barrel. The method preferably comprises the steps of: (a) inserting the rearward end portion of the replaceable rifle barrel into the barrel attachment nose of the receiver body and then (b) threadedly tightening the barrel attachment collar onto the exterior threads of the barrel attachment nose of the receiver body.

In another aspect, the method can further include the steps, after step (a), of: (i) placing a headspace gauge in a rifle chamber of the rifle apparatus and then (ii) turning the barrel adjustment nut to increase or decrease a headspace in the rifle chamber to correspond to the headspace gauge.

In another aspect, the rifle apparatus can include a barrel jam nut which is threadedly received on the threaded portion of the replaceable rifle barrel forwardly of the barrel adjustment nut.

In another aspect, where the rifle apparatus further comprises a barrel jam nut which is threadedly received on the threaded portion of the replaceable rifle barrel forwardly of the barrel adjustment nut, the method can also include the step, after step (ii), of tightening the barrel jam nut against the barrel adjustment nut to lock the barrel adjustment nut in place.

In another aspect, the rifle apparatus can include a replaceable lower receiver attachable to the bottom of the receiver body, the replaceable lower receiver having a well opening provided therethrough for receiving a magazine for loading the selected one caliber of ammunition fired by the replaceable rifle barrel.

In another aspect, the rifle apparatus can include a magazine lock lever pivotably mounted in the replaceable lower receiver and configured and positioned to contact the magazine clip received in the well opening of the replaceable lower receiver and to lock the magazine in place in the well opening.

In another aspect, the rifle apparatus can include a tension spring retained in the replaceable lower receiver in operative contact with the magazine lock lever to bias the magazine lock lever toward a locking engagement with the magazine clip.

In another aspect, the rifle apparatus can include a finger-operable release lever installed in the replaceable lower receiver for pivoting the magazine lock lever to an unlocked position to release the magazine clip from the magwell opening.

In another aspect, there is provided a rifle apparatus for firing a plurality of different calibers of ammunition comprising: (a) a receiver body; (b) a replaceable barrel which is removably attachable to the receiver body for firing at least a selected one of the plurality of different calibers of ammunition; and (c) a replaceable lower receiver attachable to the bottom of the receiver body, the replaceable lower receiver having a well opening provided therethrough for receiving a magazine clip for loading the selected one caliber of ammunition fired by the replaceable barrel.

Further aspects, features and advantages of the present invention will be apparent to those of ordinary skill in the art upon examining the accompanying drawings and upon reading the following Detailed Description of the Preferred Embodiments.

DETAILED DESCRIPTION OF THE PREFERRED EMBODIMENTS

Figure 1:
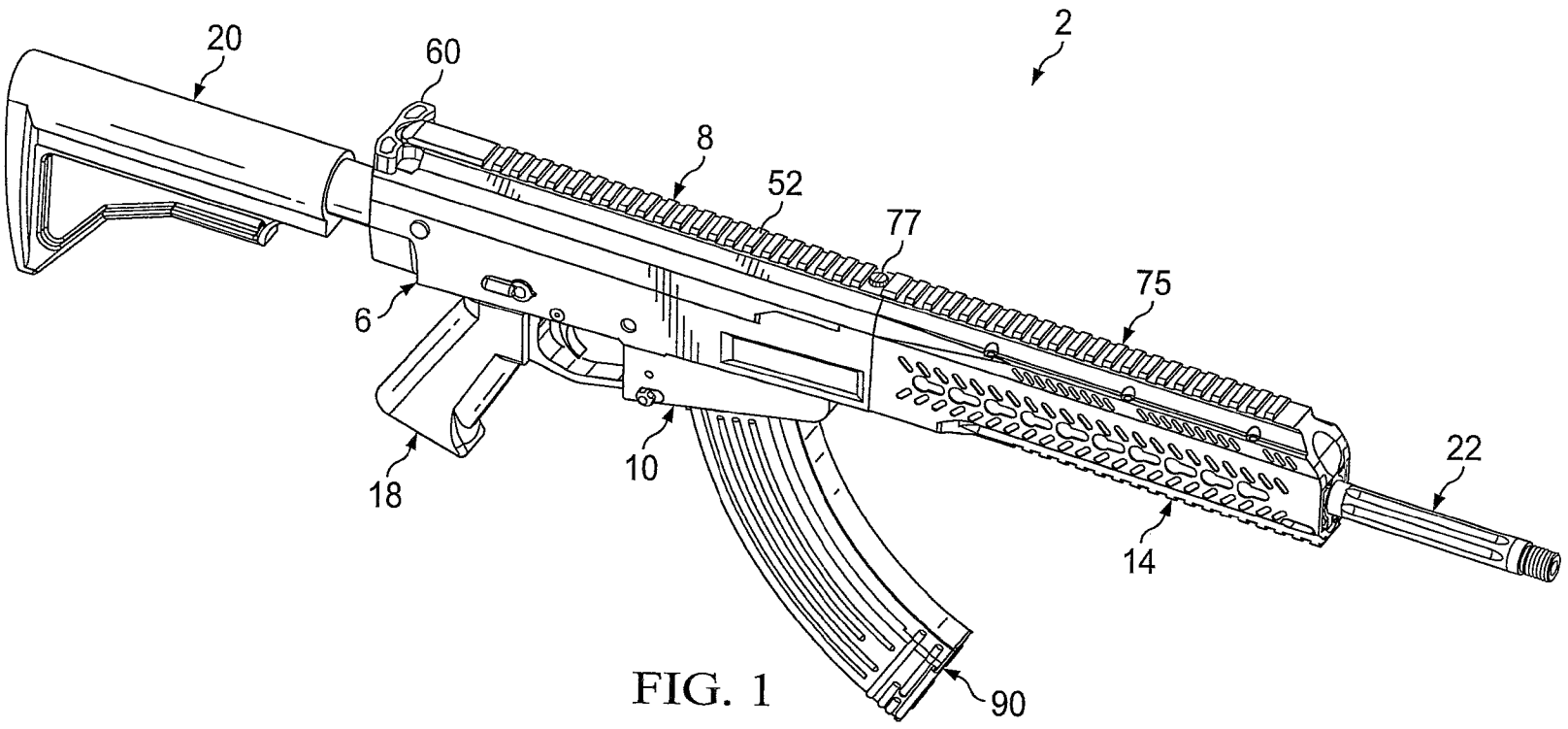
FIG. 1 is a right side perspective view of an embodiment 2 of the inventive rifle apparatus.
Figure 2:
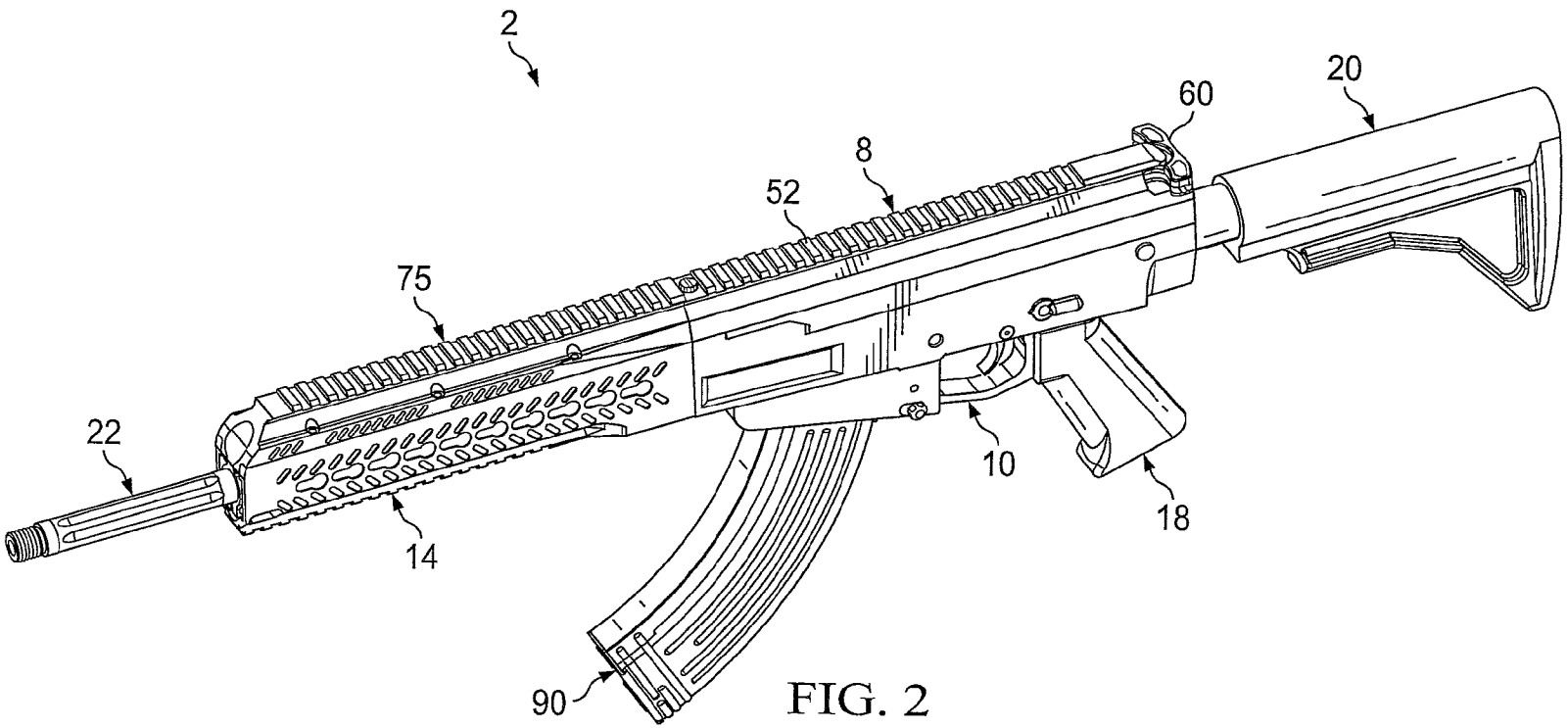
FIG. 2 is a left side perspective view of the inventive rifle 2.

An embodiment 2 of the inventive rifle apparatus is illustrated in FIGS. 1-30. The inventive rifle 2 preferably comprises: a quick-change barrel assembly 4; a threaded receiver 6 for the quick-change barrel assembly 4; a top cover charging assembly 8; a lower receiver and trigger guard assembly 10 which includes an integrated magazine retention and release system 12; a forward hand guard assembly 14 with an integrated gas tube assembly 16; a pistol grip 18 attached to the lower receiver 10; and a buttstock 20 removably attached to the threaded receiver 6.

The quick-change barrel assembly 4 used in the inventive rifle apparatus 2 can be sized for firing ammunition of generally any one of a number of possible calibers including, but not limited to, 7.62×39, 233, 5.56×45, 300 Blackout, 6.8 spc, and 6.5 Grendel. Moreover, to convert the inventive rifle 2 to the use of a different caliber of ammunition, the barrel assembly 4 and the lower magwell 10 are simply replaced with an otherwise identical barrel assembly 4 and magwell 10 of the appropriate size and barrel length for the new ammunition.

In contrast to prior systems, the inventive quick-change barrel assembly 4 also provides simple and quick adaptation and fine adjustment of the headspace within the rifle chamber for the new caliber of ammunition selected. The term "headspace" refers to the distance within the chamber of a rifle from the face of the rifle bolt or breech to the forward part or feature of the chamber which engages the cartridge to prevent the cartridge casing from moving further forward in the chamber.

The quick-change barrel assembly 4 of the inventive rifle 2 is an inventive threaded adjustable barrel system which preferably comprises a rifle barrel 22 having: (a) an enlarged rearward end portion 24 which is insertable into a forward nose 26 of the threaded receiver 6, (b) a rifle chamber 47 within the enlarged rearward end 24, (c) an extractor cutaway 53 in the rearward end of the barrel 22, (d) a longitudinal barrel alignment slot 53 in the enlarged rearward end 24, and (e) a threaded portion 28 which is adjacent to and forward of the rearward end portion 24, the threaded portion 28 having exterior threads 30. In addition, the inventive quick-change barrel assembly 4 preferably further comprises: (a) a barrel attachment collar 32; (b) a barrel adjustment nut 38 having internal threads 34; and (c) a barrel jam nut 48.

The barrel attachment collar 32 is positioned around the rearward portion 24 and/or the threaded portion 28 of the rifle barrel 22. The barrel attachment collar 32 has internal threads 34 and a forward retention shoulder 36 which projects radially inward toward the rifle barrel 22. When the enlarged rearward end portion 24 of the rifle barrel 22 is inserted into the forward nose 26 of the threaded receiver 6, the barrel attachment collar 32 is threadedly receivable over and threadedly attachable to the threaded exterior 33 of the receiver nose 26.

The barrel adjustment nut 38 is threadedly received on the threaded portion 28 of the rifle barrel 22 and has a rearward retention shoulder 42 which is positioned within the barrel attachment collar 32 and projects radially outward to engage the rearward surface 44 of the inner retention shoulder 36 of the collar 32.

The barrel jam nut 48 is threadedly received on the threaded portion 28 of the rifle barrel 22 and is positioned forwardly of and against the forward end of the barrel adjustment nut 38. The barrel jam nut 48 is used to lock the other components of the assembly in position to set the necessary headspace in the rifle chamber 45 for the caliber of ammunition selected.

Whenever any embodiment of the inventive quick-change barrel assembly 4, sized for a certain caliber of ammunition, has been previously set for use in the inventive rifle apparatus 2 to provide the proper headspace for the ammunition in the rifle chamber, the previously used barrel assembly 4 can be quickly reinstalled on the rifle 2 by (a) inserting the rearward end 24 of the rifle barrel 22 into the forward nose 26 of the threaded receiver 6 and then (b) threadedly tightening the barrel attachment collar 32 onto the threaded exterior 33 of the receiver nose 26. Similarly, any quick-change barrel assembly 4 can be easily removed from the rifle 2 by (a) loosening the barrel attachment collar 32 such that it is completely detached from the externally threaded forward nose 26 of the receiver 6 and (b) sliding the rearward end 24 of the rifle barrel 22 out of the receiver nose 26.

However, if the inventive quick-change barrel assembly 4 is a new assembly 4 (e.g., for a different caliber of ammunition) which has not been previously set for use on the rifle 2, the quick-change barrel assembly 4 can be easily adjusted and set to provide the proper headspace for the ammunition in the rifle chamber by: (1) loosening the barrel jam nut 48; (2) inserting the rearward end 24 of the rifle barrel 22 into the forward nose 26 of the threaded receiver 6; (3) placing a headspace gauge in the rifle chamber 47; (4) turning the barrel adjustment nut 38 to increase or decrease the chamber headspace to correspond to the headspace gauge; (5) tightening the barrel jam nut 48 to lock the barrel adjustment nut 38 in place; and (6) threadedly tightening the barrel attachment collar 32 onto the threaded exterior 33 of the receiver nose 26.

In contrast, to install a barrel on a standard AK 47, for example, a fixture and barrel press must be used for applying approximately 10 tons of pressure. Also, upon establishing the proper headspace, a hole must be machined through the front trunnion of the AK 47 receiver. A 7 mm barrel retaining pin must then be press fit to hold the barrel in place. Similarly, to remove the barrel from the AK 47, the retaining pin must be pressed out, the receiver and barrel assembly must be installed in the fixture and barrel press, and the barrel must be pressed out.

As noted above, the threaded barrel attachment nose 26 of the inventive rifle apparatus 2 projects from the forward end of the threaded receiver 6. The rearward end of the threaded receiver 6 preferably includes an internally threaded port 50 for removably receiving the buttstock 20 and is also preferably configured in the manner shown in FIGS. 6 and 8 for accepting an AR-style buffer tube mount system.

The top cover charging assembly 8 of the inventive rifle apparatus preferably comprises: (a) a top cover 52 with an upper Picatinny rail 54; (b) a charging handle 56 which is slideably received in the rearward end of the top cover 52 and comprises a rod 58 having a gripping handle 60 on the outer end thereof; and (c) a carrier and gas tube assembly 64 which is positioned within the top cover 52.

Figure 3:
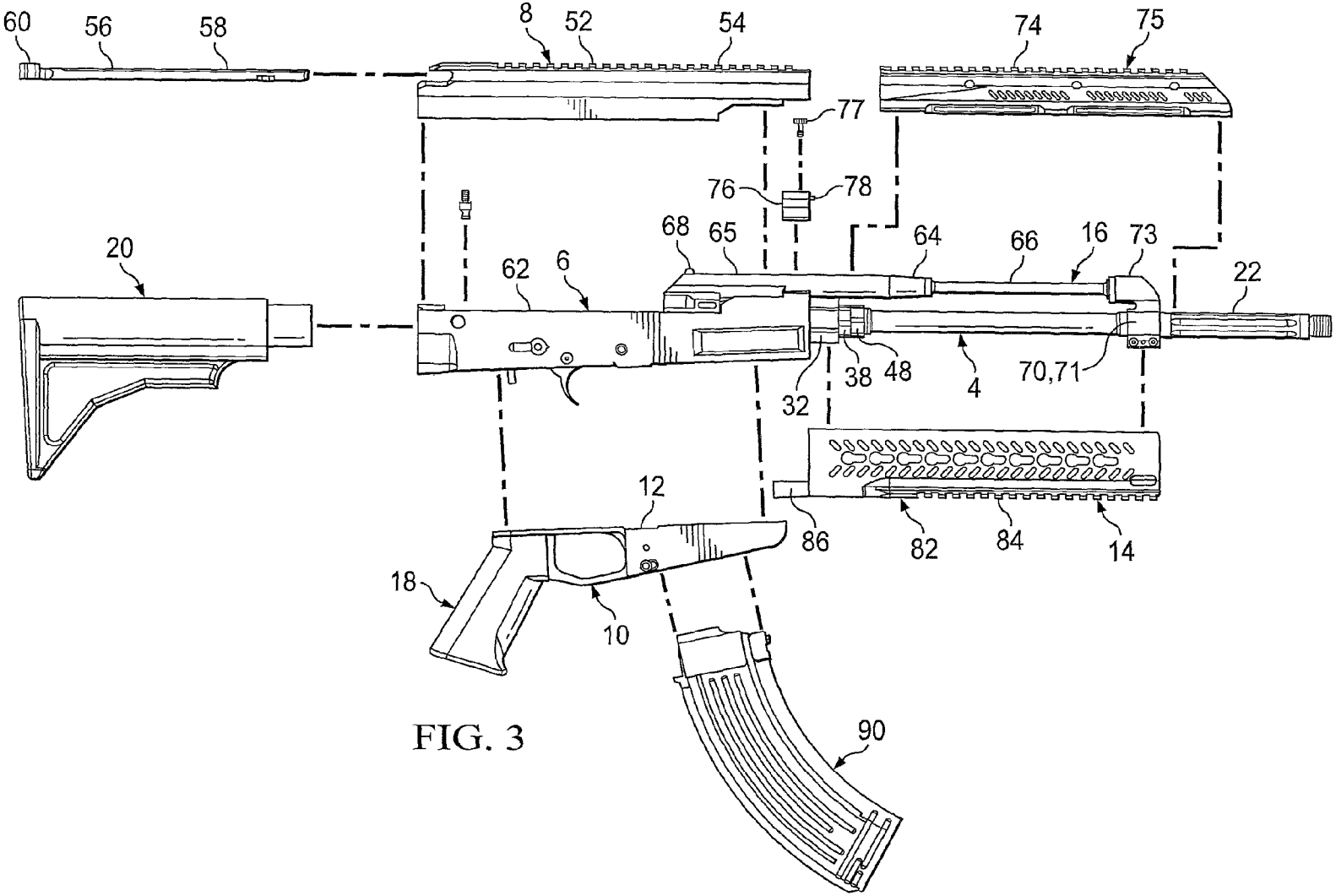
FIG. 3 is an exploded view of the inventive rifle 2.
Figure 4:
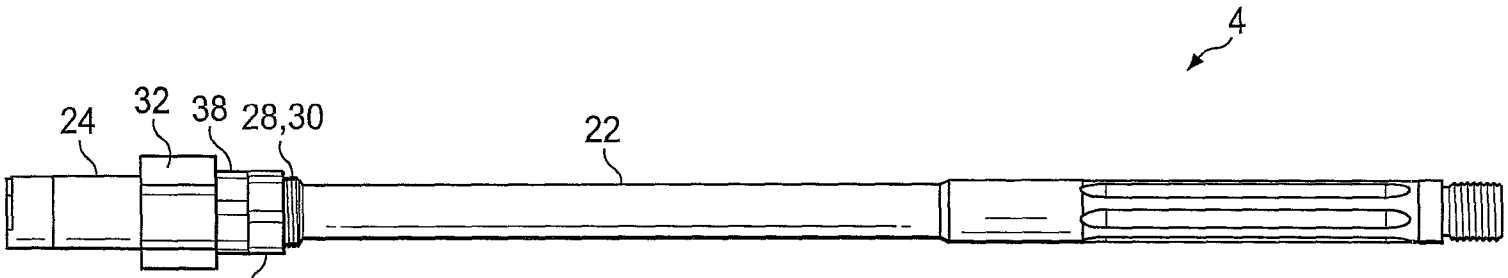
FIG. 4 is an elevational side view of an embodiment 4 of a quick-change barrel assembly used in the inventive rifle 2.
Figure 5:
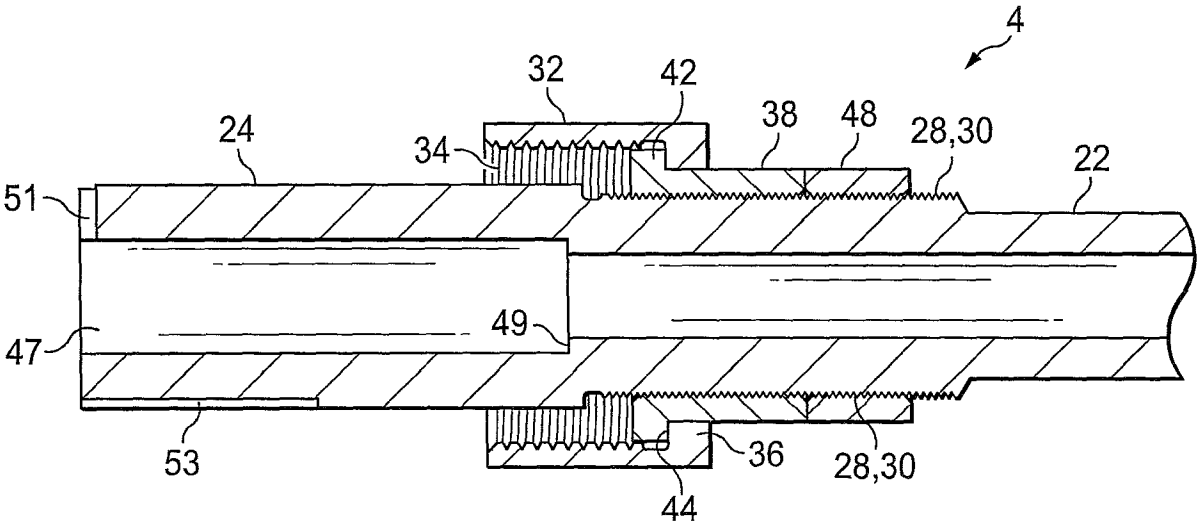
FIG. 5 is a cutaway, sectional, elevational side view of the quick-change barrel assembly 4.
Figure 6:
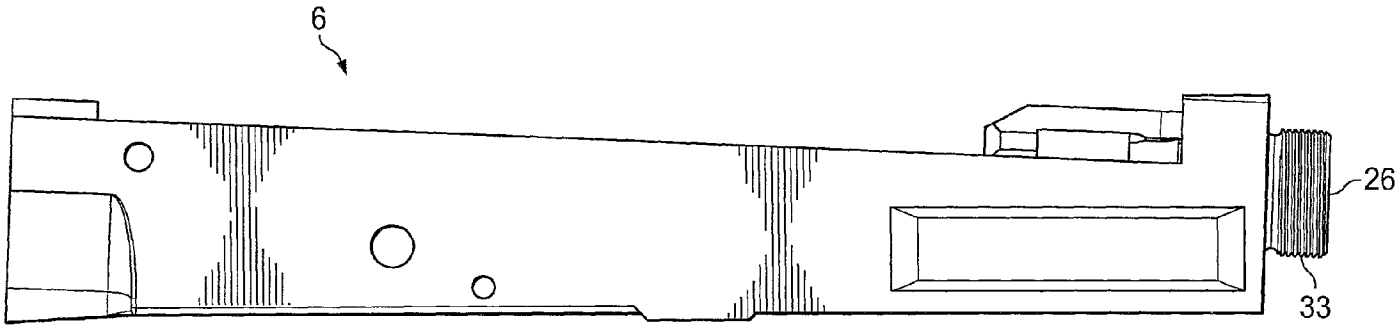
FIG. 6 is an elevational side view of a receiver 6 used in the inventive rifle apparatus 2.
Figure 7:
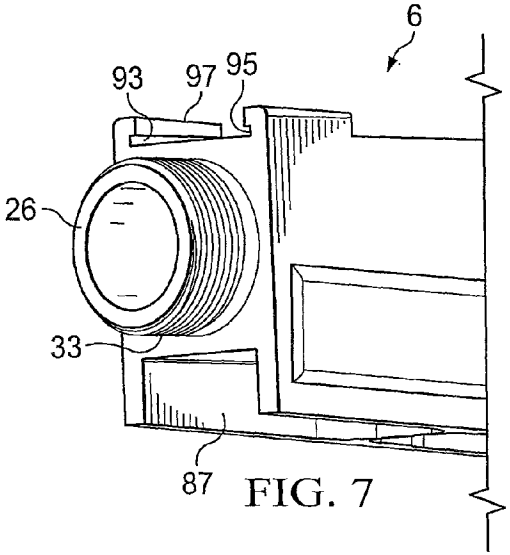
FIG. 7 is a perspective forward end view of the receiver 6.
Figure 8:
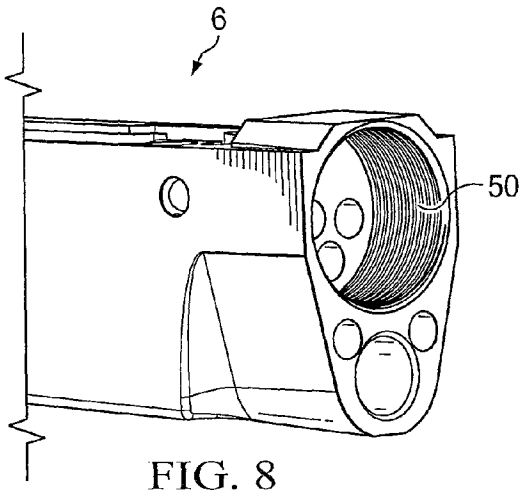
FIG. 8 is a perspective rearward end view of the receiver 6.
Figure 9:
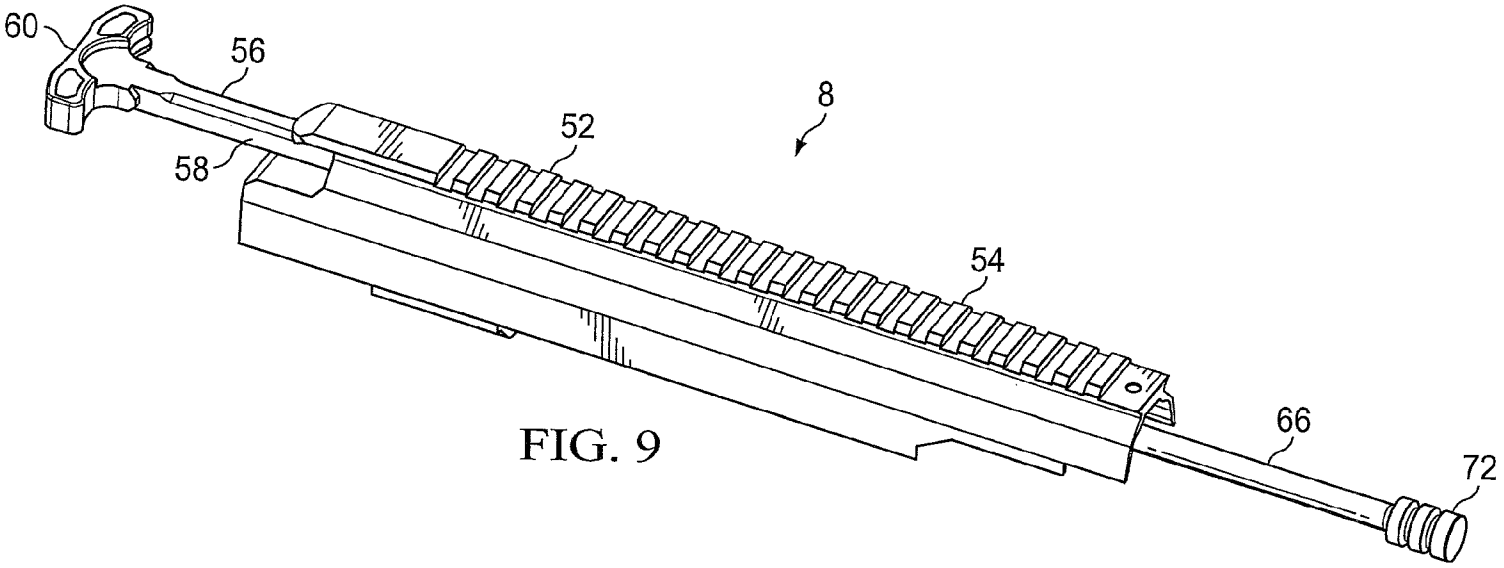
FIG. 9 is a perspective view of a top cover charging assembly 8 used in the inventive rifle apparatus 2.
Figure 10:
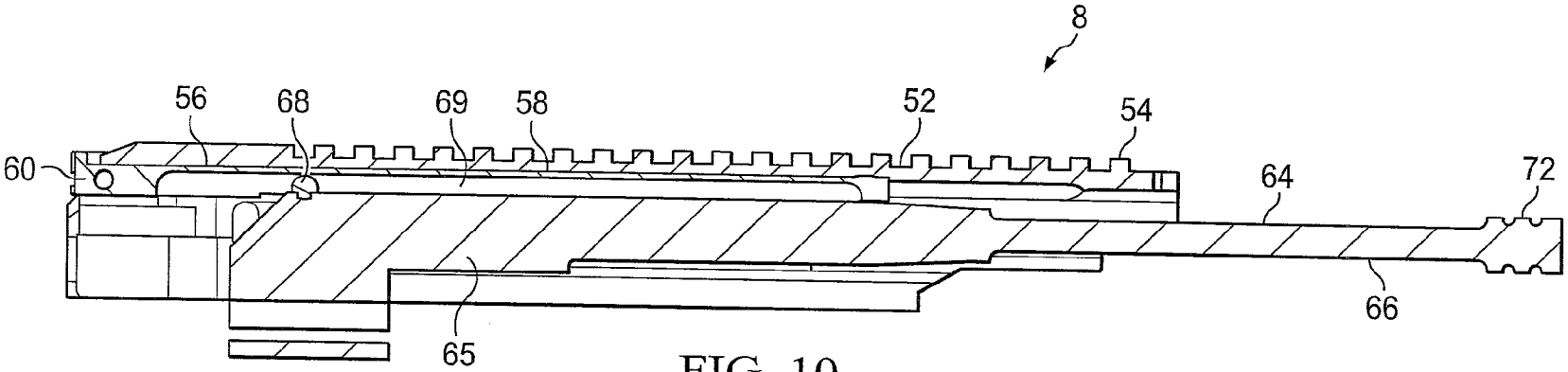
FIG. 10 is a cutaway elevational side view of the top cover charging assembly 8.
Figure 11:
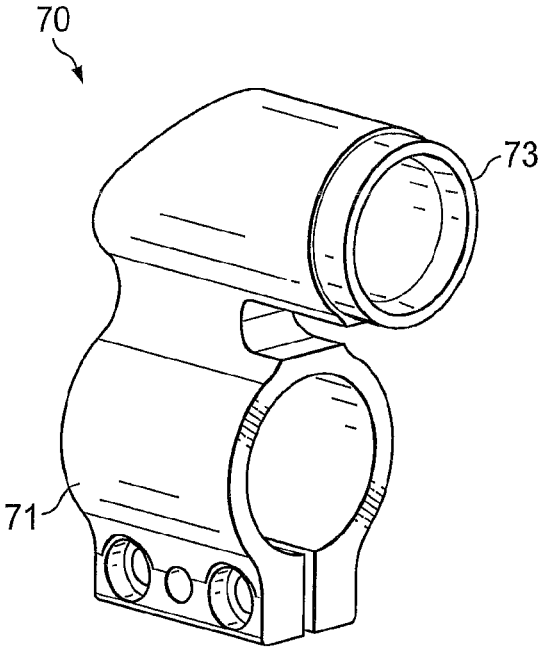
FIG. 11 is a perspective view of a quick-mount front gas block 70 used in the inventive rifle apparatus 2.
Figure 12:
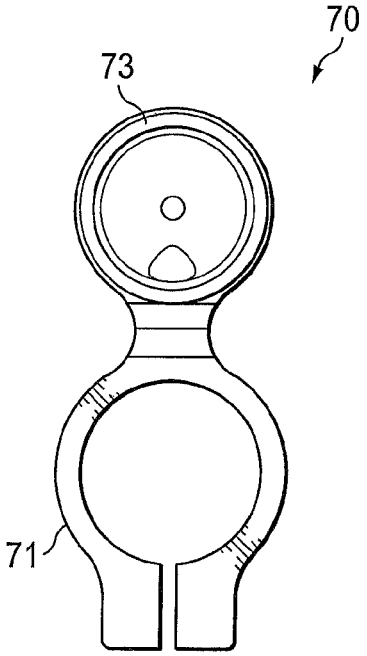
FIG. 12 is an elevational rearward view of the quick-mount front gas block 70.
Figure 13:
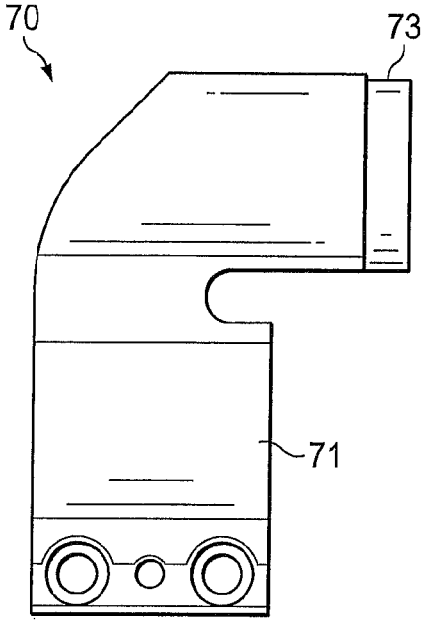
FIG. 13 is an elevational side view of the quick-mount front gas block 70.
Figure 14:
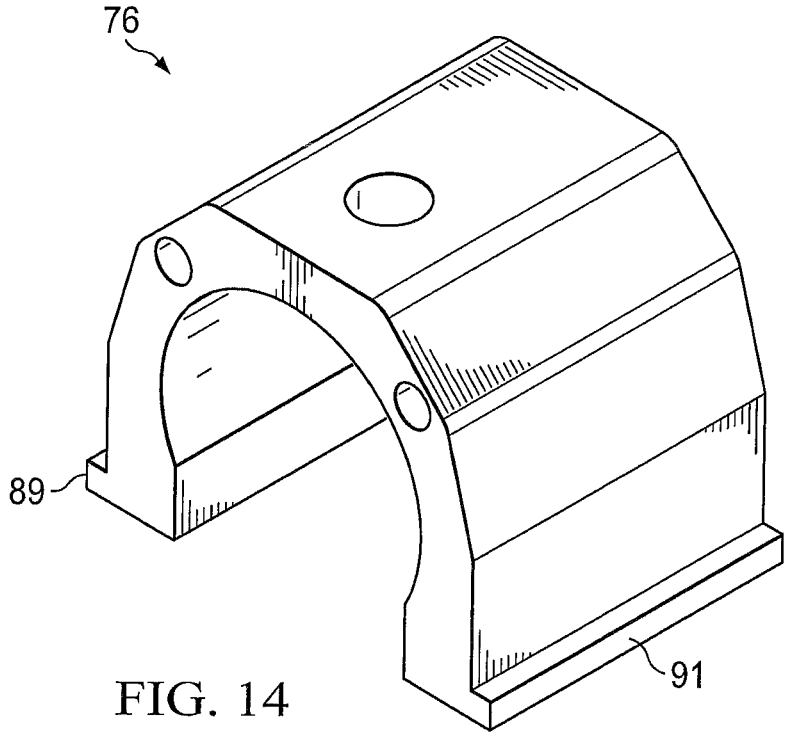
FIG. 14 is a perspective view of a gas tube rear mounting block 76 used in the inventive rifle apparatus 2.
Figure 15:
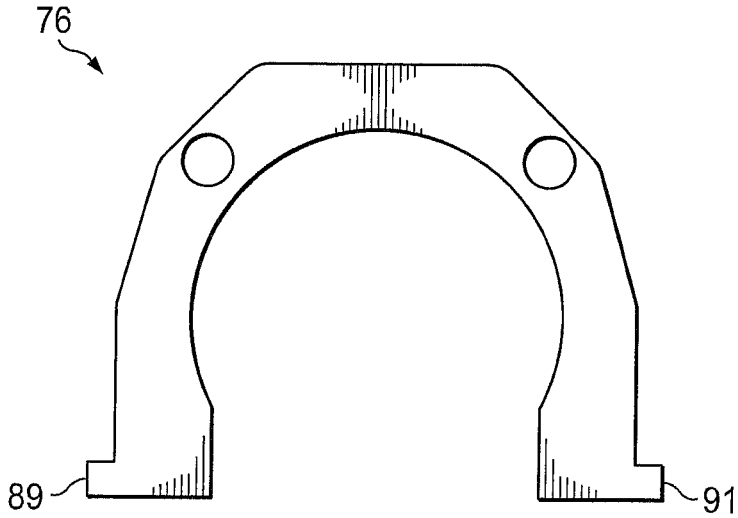
FIG. 15 is an elevational forward view of the gas tube rear mounting block 76.
Figure 16:
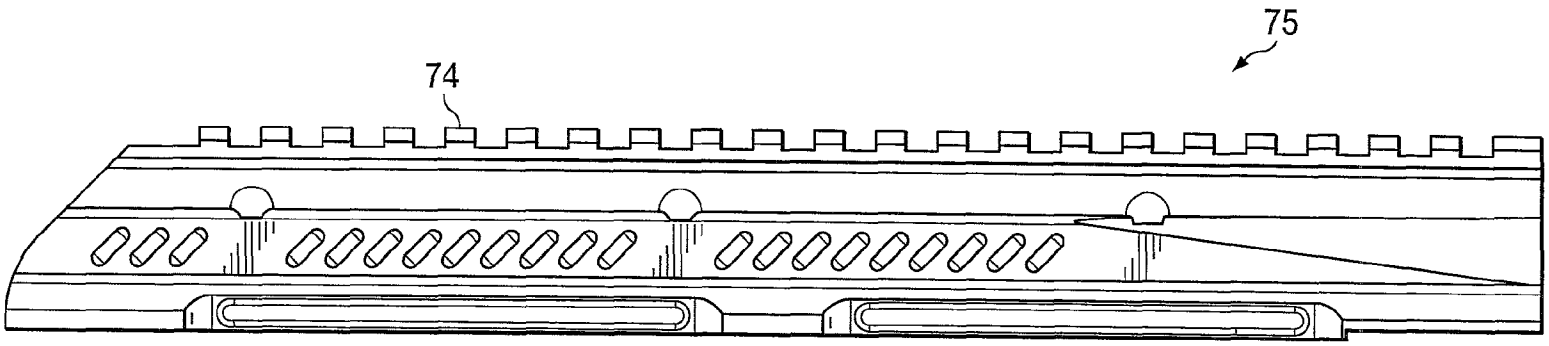
FIG. 16 is an elevational side view of an upper hand guard/gas tube 75 used in the inventive rifle apparatus 2.
Figure 17:
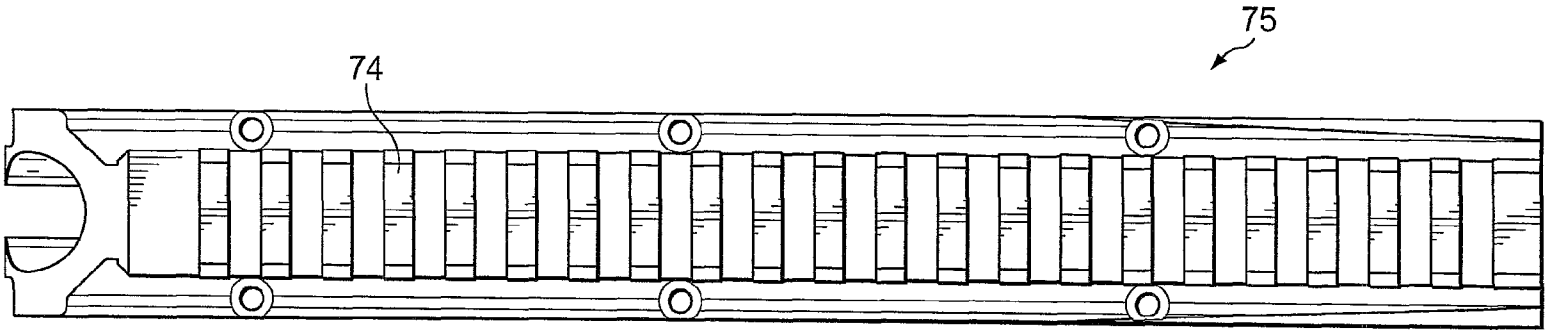
FIG. 17 is a top plan view of the upper hand guard/gas tube 75.
Figure 18:
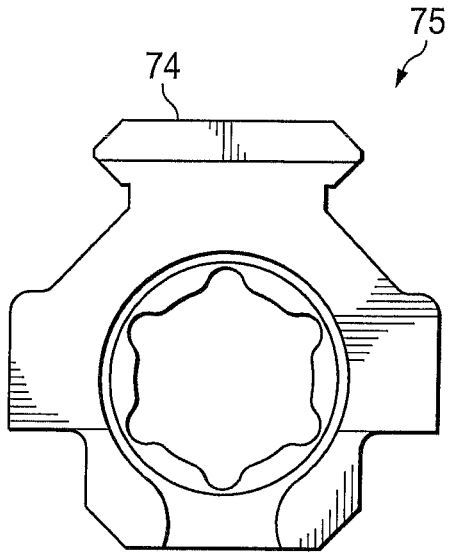
FIG. 18 is an elevational forward end view of the upper hand guard/gas tube 75.
Figure 19:
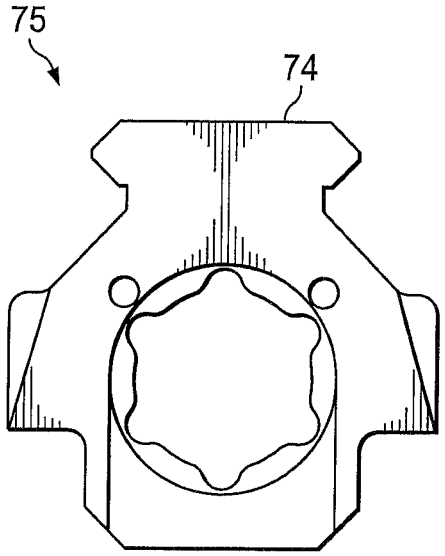
FIG. 19 is an elevational rearward end view of the upper hand guard/gas tube 75.
Figure 20:
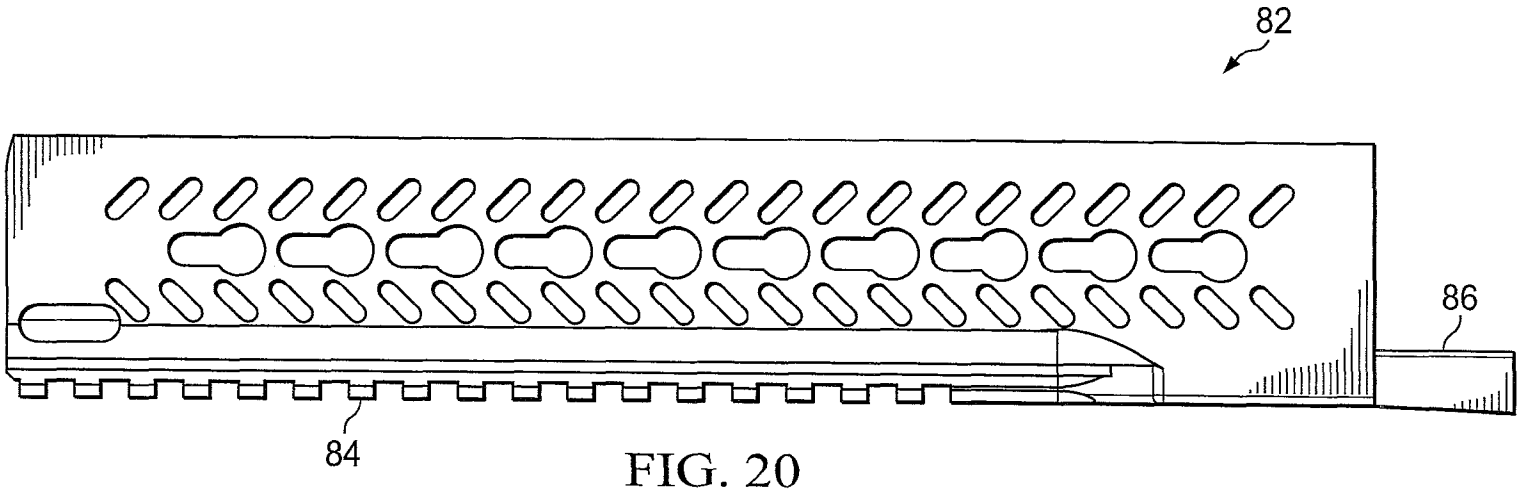
FIG. 20 is an elevational side view of a lower hand guard 82 used in the inventive rifle apparatus 2.
Figure 21:
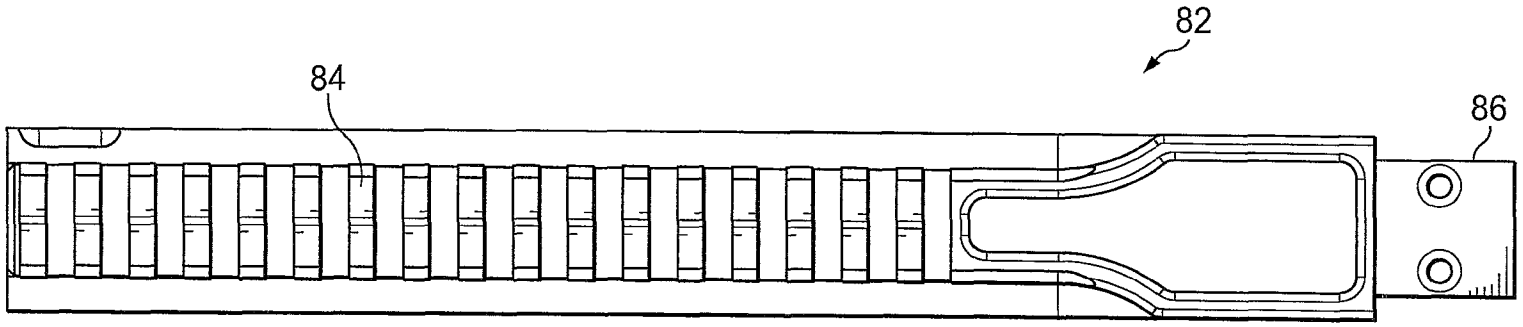
FIG. 21 is a top plan view of the lower hand guard 82.
Figure 22:
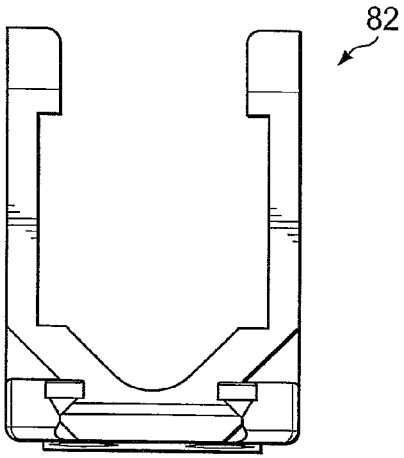
FIG. 22 is an elevational forward end view of the lower hand guard 82.
Figure 23:
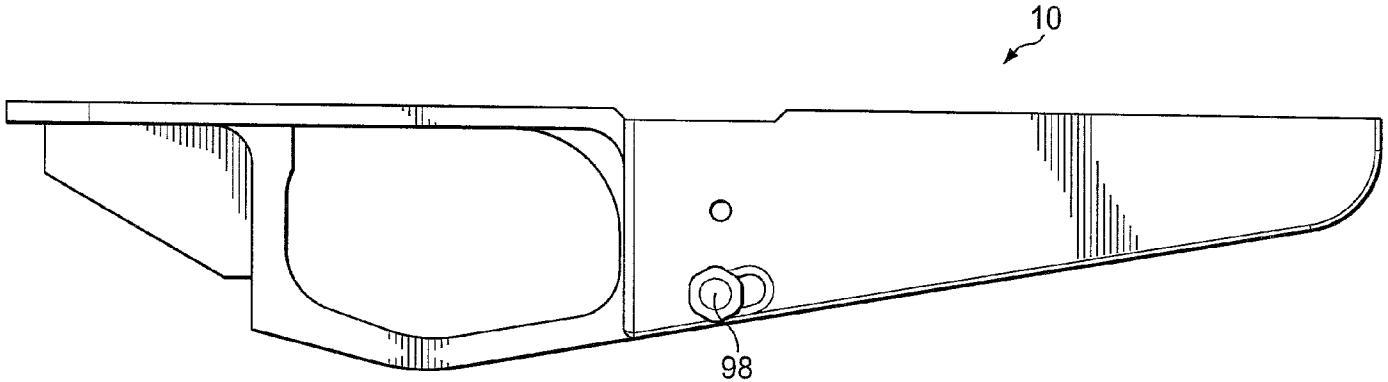
FIG. 23 is an elevational side view of a replaceable lower receiver 10 and integrated magazine retention and ambidextrous release system 12 used in the inventive rifle 2.
Figure 24:
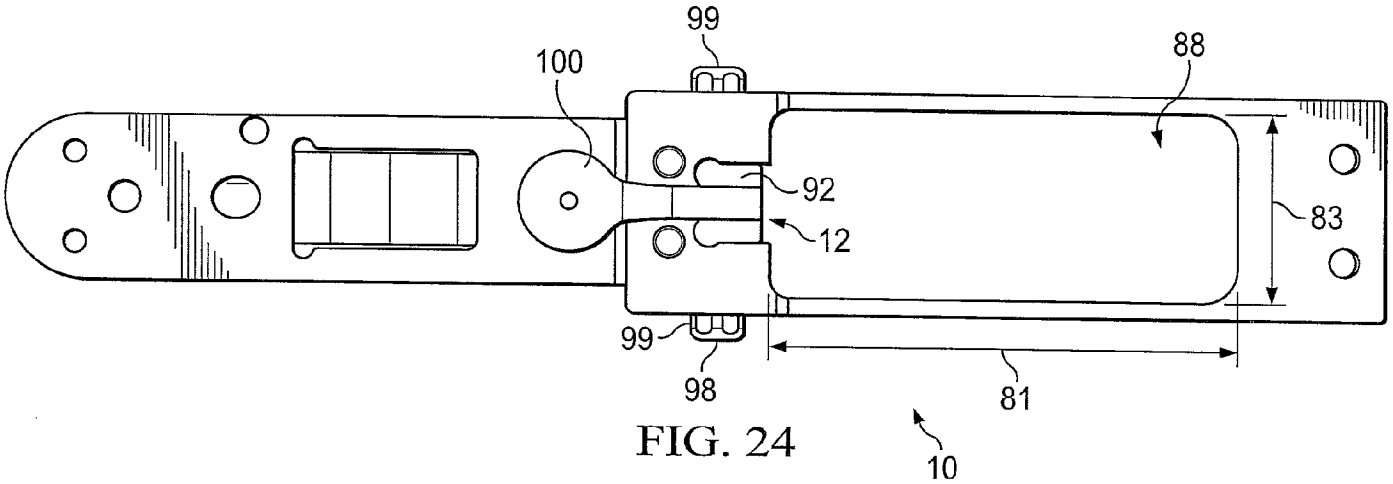
FIG. 24 is a top plan view of the lower receiver 10 and integrated magazine retention and ambidextrous release system 12.
Figure 25:
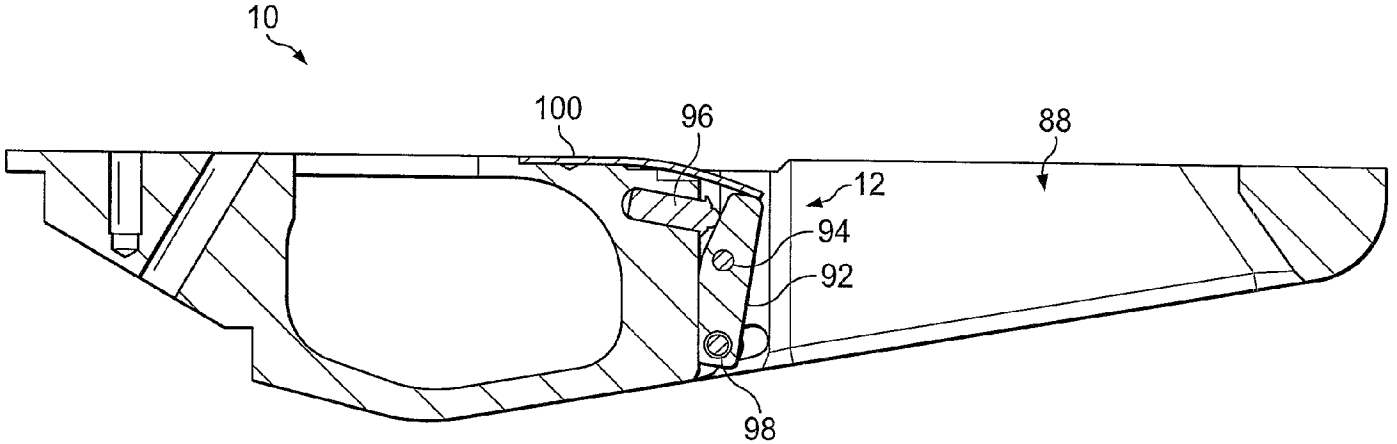
FIG. 25 is a cutaway elevational side view of the lower receiver 10 and integrated magazine retention and ambidextrous release system 12.
Figure 26:
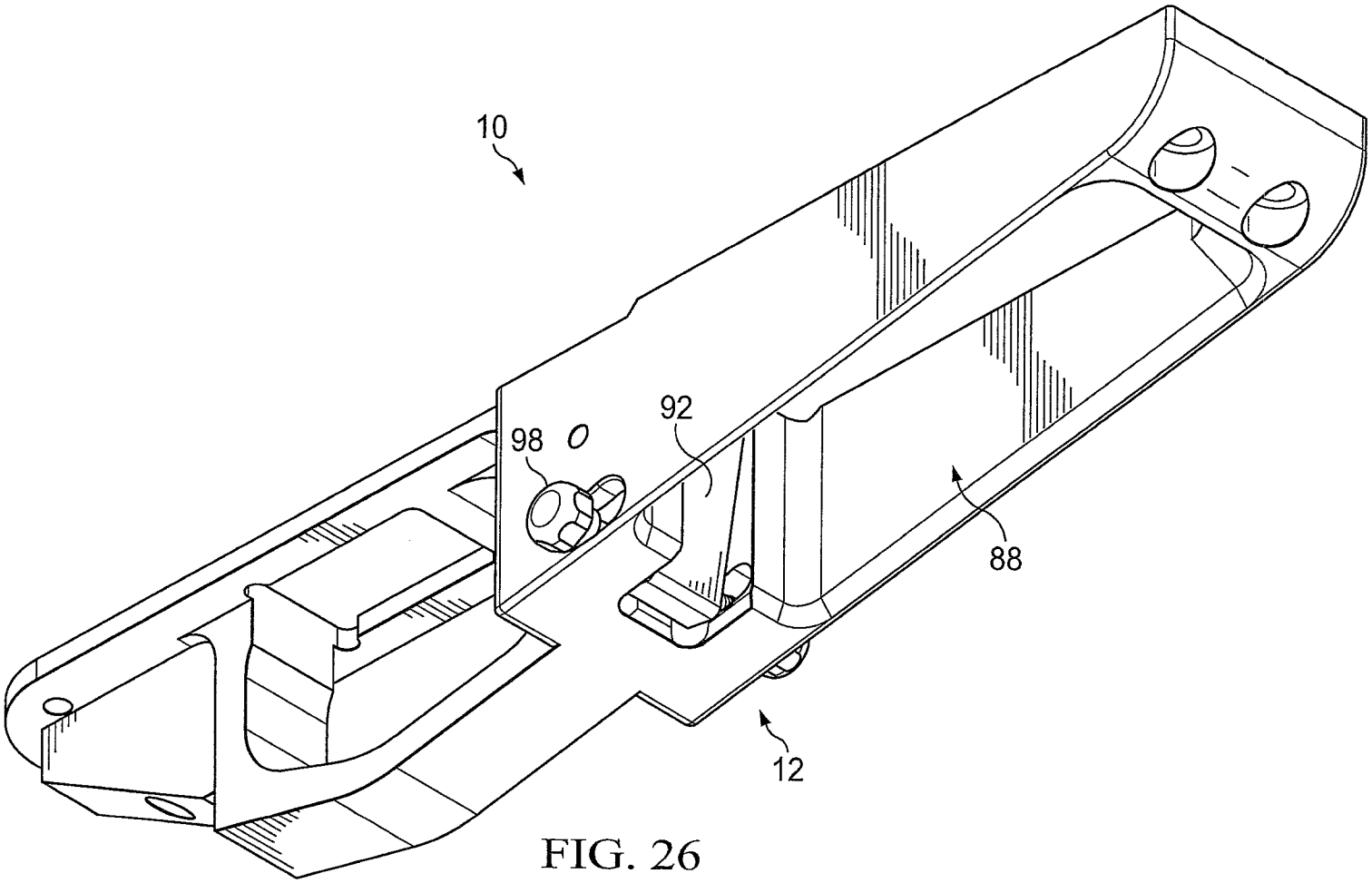
FIG. 26 is a perspective view of the lower receiver 10 and integrated magazine retention and ambidextrous release system 12.
Figure 27:
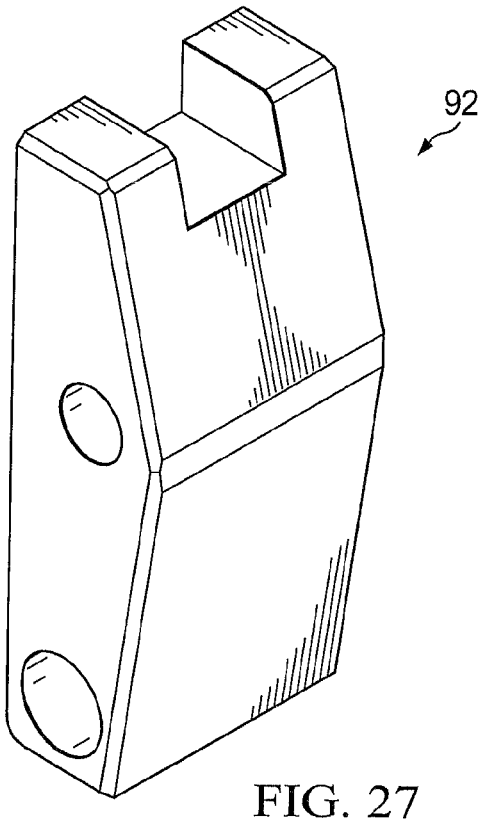
FIG. 27 is a perspective view of a magazine lock and release lever 92 used in the integrated magazine retention and ambidextrous release system 12.
Figure 28:
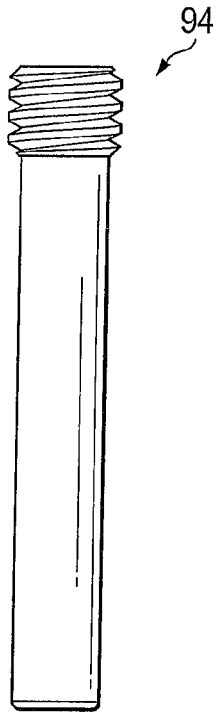
FIG. 28 is a perspective view of a pivot pin 94 used in the integrated magazine retention and ambidextrous release system 12.
Figure 29:
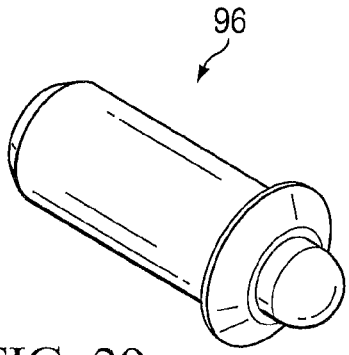
FIG. 29 is a perspective view of a tension spring 96 used in the integrated magazine retention and ambidextrous release system 12.
Figure 30:
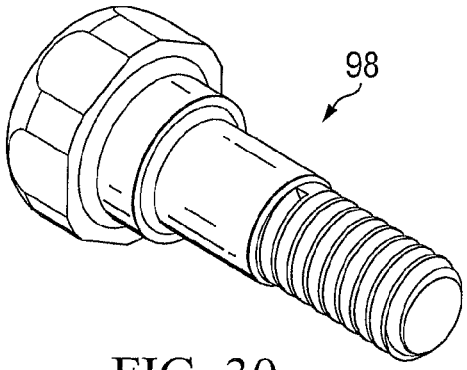
FIG. 30 is a perspective view of a finger-operated release lever 98 used in the integrated magazine retention and ambidextrous release system 12.
Figure 31:
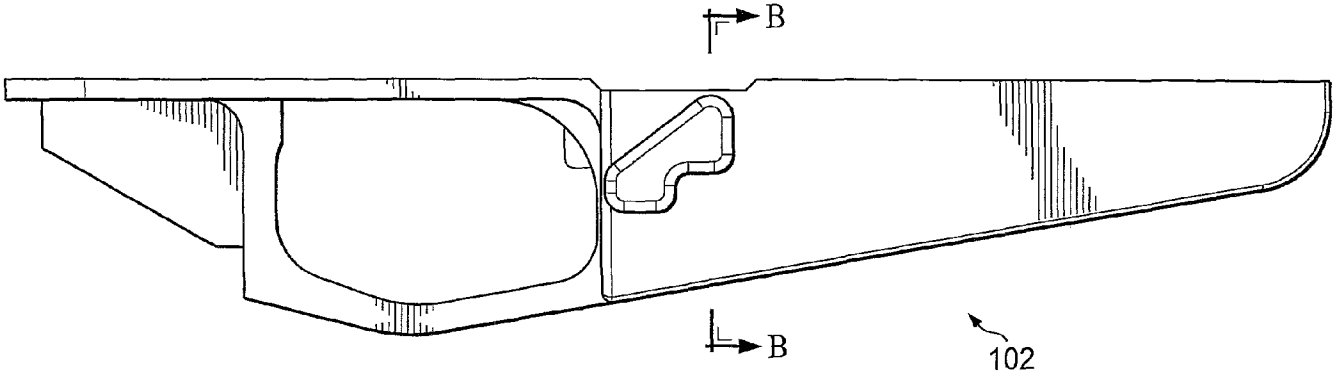
FIG. 31 is an elevational side view of an alternative replaceable lower receiver 102 for the inventive rifle apparatus 2.
Figure 32:
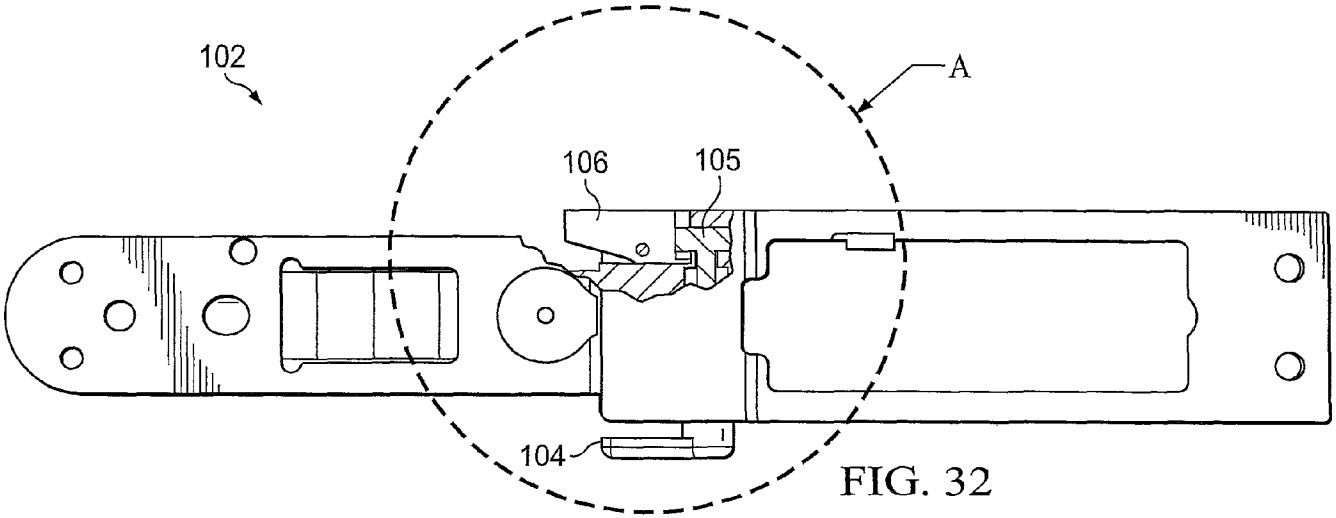
FIG. 32 is a top view of the alternative lower receiver 102.
Figure 33:
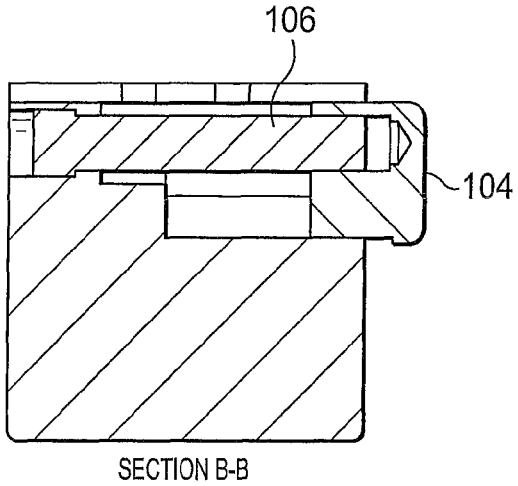
FIG. 33 is a cutaway view of the replaceable lower receiver 102 as seen from perspective B-B shown in FIG. 31.
Figure 34:
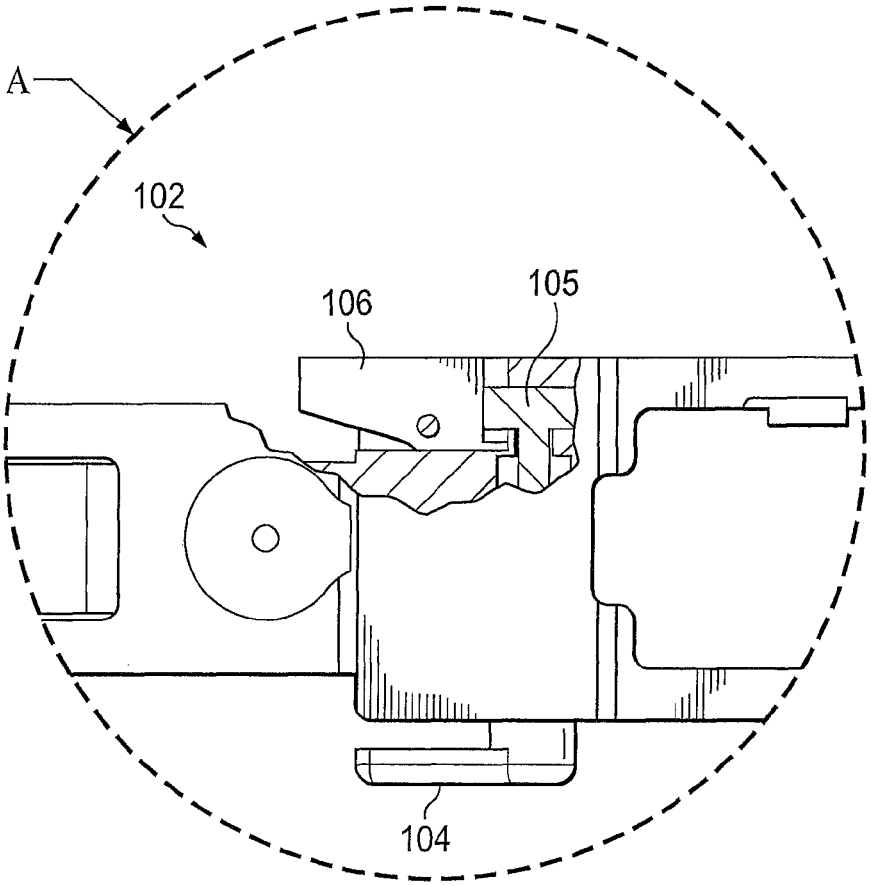
FIG. 34 is an enlarged view of section A of the lower receiver 102 shown in FIG. 32.
Figure 35:
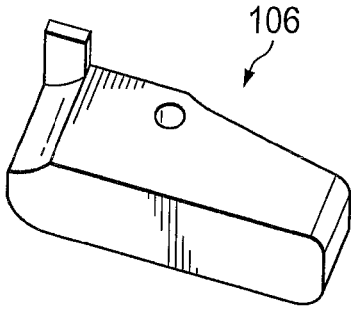
FIG. 35 is a perspective view of a finger-operatable left side release lever 106 used in the lower receiver 102.
Figure 36:
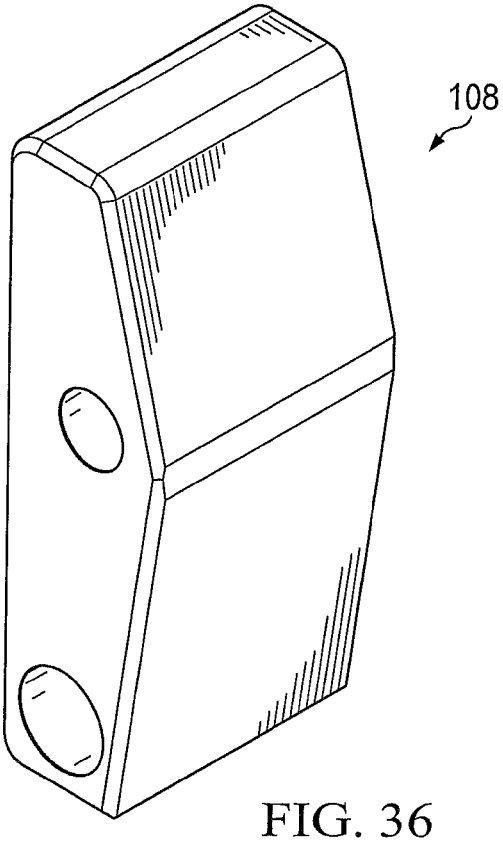
FIG. 36 is a perspective view of a magazine lock and release lever 108 used in the integrated magazine retention and ambidextrous release system of the lower receiver 102.
Figure 37:
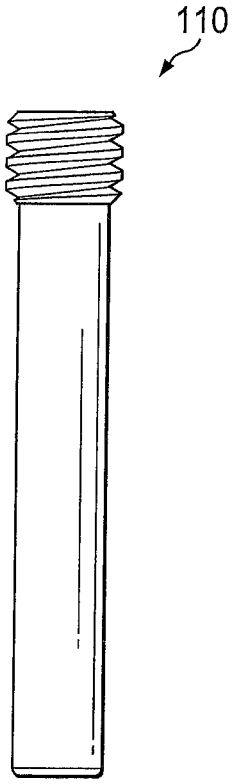
FIG. 37 is a perspective view of a pivot pin 110 used in the integrated magazine retention and ambidextrous release system of the lower receiver 102.
Figure 39:
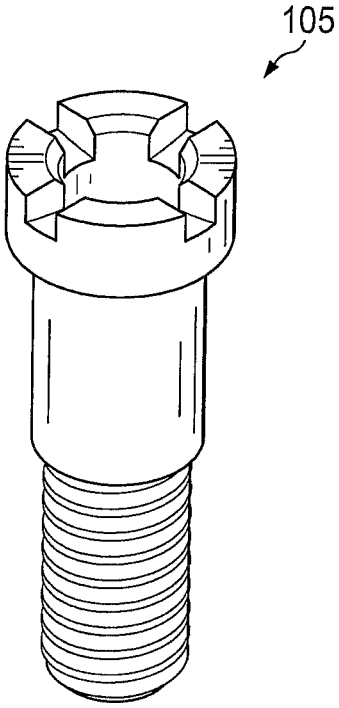
FIG. 39 is a perspective view of a magazine release extension screw 105 used in the integrated magazine retention and ambidextrous release system of the lower receiver 102.
Figure 38:
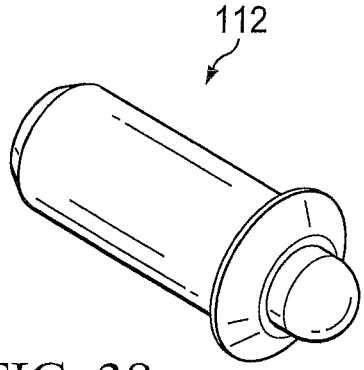
FIG. 38 is a perspective view of a tension spring 112 used in the integrated magazine retention and ambidextrous release system of the lower receiver 102.
Figure 40:
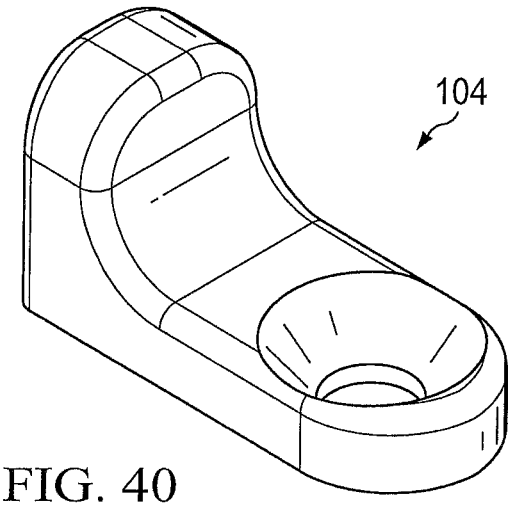
FIG. 40 is a perspective view of a finger-operatable right side tactical release tab 104 used in the integrated magazine retention and ambidextrous release system of the lower receiver 102.

As seen in FIGS. 3, 9, and 10, the carrier and gas tube assembly 64 comprises: a carrier 65 which is reciprocatably mounted in a slide 62 in the top of the threaded receiver 6 for operation of the rifle firing chamber; an elongate gas tube 66 which is slideably received in the forward end of the carrier 65 for reciprocating movement of the carrier 65 on the tube 66 to provide fully automatic or semi-automatic operation of the inventive rifle apparatus 2; and a carrier boss 68 provided on the top of the carrier 65 which is slidably received in a groove 69 in the bottom of the rod 58 of the charging handle 56 for engagement by the charging handle 56 when the charging handle 56 is pulled rearwardly for chambering a round.

The forward hand guard assembly 14 of the inventive rifle apparatus 2, and the gas tube assembly 16 which is integrated therewith, preferably include a quick-mount front gas block 70 which has a bottom clamp portion 71 that is secured (e.g., using clamping bolts or screws) on the rifle barrel 22 over a small gas port (not shown) provided in the top of the barrel 22. The quick-mount front gas block 70 also has an upper gas discharge port 73 that receives the forward end 72 (i.e., the gas inlet end) of the gas tube 66.

In addition, the forward hand guard assembly 14 and integrated gas tube assembly 16 preferably also include: (a) an upper hand guard 75, with a top Picatinny rail 74, which is positioned over the barrel 22, and in which the gas tube 66 and the front gas block 70 are received; (b) a gas tube rear mounting block 76 with an inverted U shape which is positioned over the carrier 65; and (c) a lower hand guard 82, with cross-sectional U shape and a bottom Picatinny rail 84, which is positioned beneath the rifle barrel 22 and includes a rearwardly projecting bottom bracket 86 which is attached by bolts or screws to the bottom of the receiver 6. The upper hand guard 75 and the lower hand guard 82 are also removably attached together using bolts or screws.

The gas tube rear mounting block 76 has a pair of outwardly projecting side flanges 89 and 91 on the bottom thereof which are removably receivable in an opposing pair of grooves 93 and 95 of an attachment slot 97 provided on the top of the receiver 6 at the forward end thereof. With the rear mounting block 76 in place in the attachment slot 97, the top cover 52 can be removably secured to the top of the rear mounting block 76 using a bolt or screw 77.

The lower receiver and trigger guard body 10 is attached to the bottom of the receiver body 6 and, as noted above, includes an integrated magazine retention and ambidextrous release system 12. The lower receiver 10 and integrated magazine retention and release system 12 include a well opening 88 for receiving a magazine clip 90 for loading ammunition of a selected caliber as discussed above The lower receiver 10 and integrated magazine retention and release system 12 further comprise: a magazine lock and release lever 92 which is pivotably mounted at the rearward end of the well opening 88; a pivot pin 94 on which the lever 92 is pivotably mounted in the lower receiver 10; a tension spring 96 mounted in the lower receiver 10 for biasing the pivotable lock/release lever 92 into locking engagement with the magazine clip 90; an index finger-operatable release 98 which extends laterally through the lower portion of the magazine lock, the release lever 98 having a pushable button 99 on each side of the lower receiver 10 which can be pushed using either hand to thereby pivot the lock and release lever 92 out of locking position for releasing the magazine clip 90; and an anti-rattle spring 100 for reducing or eliminating the rattle of the magazine 90.

An alternative embodiment 102 of the replaceable lower receiver for the inventive rifle 2 is illustrated in FIGS. 31-40. Rather than utilizing the ambidextrous magazine release system 12 described above, the lower receiver 102 uses an alternative ambidextrous integrated magazine retention system which comprises (a) a pivotable, finger-operatable, exterior tactical right side release tab 104 which rotates an internal magazine release extension screw 105 for releasing the magazine clip 90 and (b) a pivotable, finger-operatable left side release lever 106 which also interacts with the opposite end of the release extension screw 105 for releasing the magazine clip 90.

In addition, similar to the magazine retention and release system 12, the magazine retention and release system of the lower receiver 102 further comprises: a magazine lock and release lever 108; a pivot pin 110 for the lever 108; and a tensioning spring 112.

Thus, the present invention is well adapted to carry out the objects and attain the ends and advantages mentioned above as well as those inherent therein. While presently preferred embodiments have been described for purposes of this disclosure, numerous changes and modifications will be apparent to those of ordinary skill in the art. Such changes and modifications are encompassed within this invention as defined by the claims.

What is claimed is:

1. A rifle apparatus comprising a receiver body; a rifle barrel attached to a forward end of the receiver body; and a top cover charging assembly comprising:

a carrier which slides on an exterior top of the receiver body;

a mounting block which is removably secured on a forward portion of the exterior top of the receiver body so that the carrier slides through the mounting block;

a removeable top cover which is removeably attached to the mounting block and is removably positioned over the exterior top of the receiver body and over at least a rearward portion of the carrier; and a charging handle comprising a rod having a gripping handle on a rearward end of the rod wherein the rod is slideably received through a rearward end of the removable top cover, the gripping handle is positioned outside of the rearward end of the removable top cover, and, when the gripping handle is pulled rearwardly, the rod engages the carrier and pulls the carrier rearwardly on the exterior top of the receiver body for chambering a round in the rifle apparatus.

2. The rifle apparatus of claim 1 wherein the rifle barrel is removably attached to the forward end of the receiver body.

3. The rifle apparatus of claim 1 wherein an exterior Picatinny rail extends along at least a portion of a top side of the removable top cover.

4. The rifle apparatus of claim 1 wherein:

an elongate slot is provided in a bottom side of the rod of the charging handle;

an upwardly projecting boss on top of the carrier is received in the elongate slot; and when the charging handle is pulled rearwardly, a forward end of the elongate slot engages the upwardly projecting boss to pull the carrier rearward on the exterior top of the receiver body for chambering a round in the rifle apparatus.

5. The rifle apparatus of claim 1 wherein the mounting block has an inverted U shape which is removably positioned over a longitudinal portion of the carrier for sliding movement of the carrier through the mounting block, the mounting block also has a lower pair of opposing, outwardly extending flanges which are received in an opposing pair of grooves of an attachment slot on the exterior top of the receiver body, and wherein a forward end portion of the removable top cover is received over the mounting block and is removably attached to the mounting block by bolt or screw.

* * * * *